United States Patent [19]

Conner, Jr.

[11] 4,186,674

[45] Feb. 5, 1980

[54] APPARATUS FOR GUIDING WORK THROUGH A SEWING MACHINE OR THE LIKE

[75] Inventor: William R. Conner, Jr., Shelbyville, Tenn.

[73] Assignee: Stahl-Urban Company, Brookhaven, Miss.

[21] Appl. No.: 847,743

[22] Filed: Nov. 2, 1977

[51] Int. Cl.[2] ..... D05B 35/10

[52] U.S. Cl. ..... 112/153; 112/DIG. 2

[58] Field of Search ..... 112/153, 152, DIG. 1, 112/DIG. 2, DIG. 3

[56] References Cited

U.S. PATENT DOCUMENTS

| | | | |
|---|---|---|---|
| 3,204,591 | 9/1965 | Pickett | 112/147 X |
| 3,252,437 | 5/1966 | Pickett | 112/136 |
| 3,268,222 | 8/1966 | Off | 271/74 |
| 3,476,003 | 11/1969 | Adams | 112/DIG. 2 |
| 3,631,826 | 1/1972 | Morgan | 112/153 X |
| 3,825,250 | 7/1974 | Miller | 112/DIG. 2 |
| 3,886,877 | 6/1975 | Akaishi et al. | 112/147 X |

FOREIGN PATENT DOCUMENTS

| | | | |
|---|---|---|---|
| 2641323 | 3/1977 | Fed. Rep. of Germany | 112/153 |

*Primary Examiner*—Wm. Carter Reynolds
*Attorney, Agent, or Firm*—Senniger, Powers, Leavitt and Roedel

[57] ABSTRACT

Apparatus for guiding work through a sewing machine in which the work, as it is fed through the machine, is biased laterally into engagement with an edge guide by a vacuum-induced flow of air. The apparatus is particularly useful for guiding superposed plies of material as they are fed through the machine and aligning the edges of the plies along which they are stitched by the machine.

15 Claims, 6 Drawing Figures

APPARATUS FOR GUIDING WORK THROUGH A SEWING MACHINE OR THE LIKE

BACKGROUND OF THE INVENTION

This invention relates to apparatus for guiding work through a sewing machine or the like, and more particularly to such apparatus for aligning edges of superposed plies of material as the plies are fed through the machine for being joined along the aligned edges.

The invention is generally in the same field as the devices shown in such U.S. patents as U.S. Pat. Nos. 3,252,437, 3,631,826 and 3,825,250, and may be regarded as involving an improvement over these prior devices.

SUMMARY OF THE INVENTION

Among the several objects of the invention may be noted the provision of improved apparatus for guiding work through a sewing machine or the like, providing more consistently accurate guidance; the provision of such apparatus which is especially useful for guiding superposed plies of material, e.g., knit fabrics, as they are fed through the machine and for aligning edges of the plies for stitching along the aligned edges; the provision of such apparatus in which the work is adapted to travel freely therethrough and to be freely movable therein for improved guidance; and the provision of such apparatus wherein, in guiding superposed plies, the plies are individually freely movable for edge alignment.

In general, apparatus of this invention comprises guide means through which the work is fed to the machine, said guide means comprising an upper member and a lower member spaced apart for passage therebetween of the work and an edge guide at one side of the upper and lower members for engagement by the edge of the work toward said one side as the work travels through said guide means. The guide means is open at the other side and at both ends for passage of the work therethrough and for entry of air to the space between said members. It has at least one air passage at said one side thereof. Vacuum means is connected to the air passage for drawing air into the guide means and causing the air to flow toward said one side of the guide means and thence out through the air passage, the air biasing the work laterally in the direction toward the edge guide for engagement with the edge guide of the edge of the work toward the edge guide.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
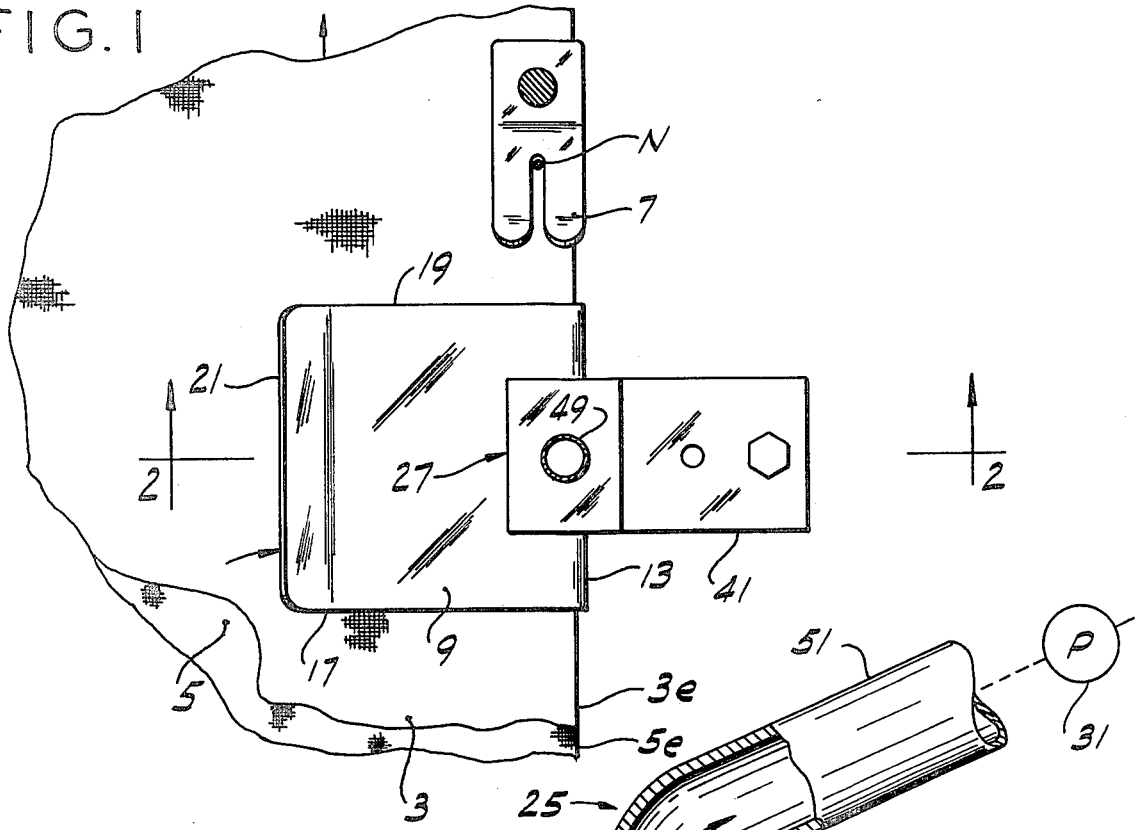
FIG. 1 is a view in plan showing apparatus of this invention guiding work (two superposed plies of material) to the needle of a sewing machine.

Referring to the drawings, apparatus of this invention for guiding work W through a sewing machine or the like is shown to comprise a guide means 1 through which the work is fed, the work being shown as comprising two plies 3 and 5 of fabric material, e.g., woven or knit textile fabric material, one superposed on the other. The superposed plies are shown in FIG. 1 as being fed to the needle N of a sewing machine, the presser foot of the sewing machine being indicated at 7. The guide means guides the plies to the needle and aligns the edges 3*e* and 5*e* of the plies along which they are to be stitched by the sewing machine.

As illustrated, the guide means 1 is constituted by a channel formed of a rectangular piece of sheet metal bent into a narrow C-shape (see FIG. 2), thereby having a flange portion 9 forming an upper member of the channel, a flange portion 11 forming a lower member of the channel, these members being spaced apart a distance sufficient for free passage therebetween of the work, and a narrow web portion 13 interconnecting the two flange portions forming an edge guide at one side (the right side as viewed in FIGS. 1 and 2) of the upper and lower members 9 and 11 of the channel for engagement by the edges 3*e* and 5*e* of the two plies 3 and 5 of the work as they travel through the guide channel. The guide channel is open at the other side thereof (its left side as viewed in FIGS. 1 and 2) as indicated at 15 in FIG. 2, and at both of its ends, which are indicated at 17 and 19 in FIG. 1, for passage of the work therethrough and for entry of air to the space in the channel as will appear. The upper member 9 of the guide channel has its margin at the open side 15 bent up as indicated at 21 to facilitate entry of the work in the guide channel.

Figure 4:
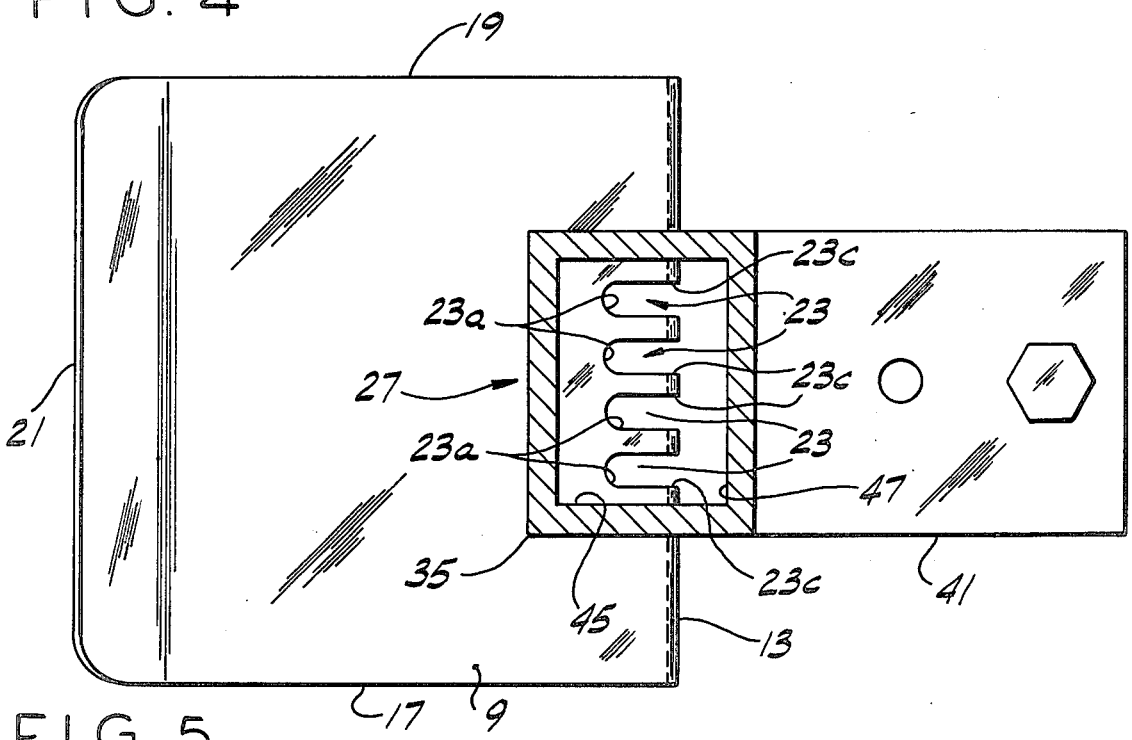
FIG. 4 is a horizontal section on line 4—4 of FIG. 2.

In accordance with this invention, the guide channel 1 has at least one air passage at the stated one side thereof (i.e., the side where it has the edge guiding web 13), and as shown in FIG. 4 has a plurality of air passages each designated 23. Each of these air passages is conveniently formed by providing the guide channel with slots extending in from the edge of the guide channel constituted by the web portion 13, cut in the web portion 13 and the upper and lower members 9 and 11, the slots being spaced at intervals along the length of the guide channel. Thus, the guide channel has air passages 23*a* in the upper member 9, air passages 23*b* in the lower member 11 and air passages 23*c* in the edge guide 13, all formed by the slots 23.

Vacuum means indicated generally at 25 is connected to the air passages 23*a, b* and *c* for drawing air into the guide channel 1 and causing the air to flow toward the edge guide side of the guide channel and thence out through the air passages. This vacuum means comprises a vacuum manifold generally designated 27 in sealed relation with the guide channel and in communication with the air passages 23*a, b, c* and having an outlet 29 for connection to means such as a vacuum pump 31 for drawing air into the guide channel and causing it to flow in the direction toward the edge guide 13 and thence out through the air passages. The vacuum manifold 27 comprises a lower portion 33 at the bottom of the guide channel, an upper portion 35 at the top of the guide and a portion 37 extending alongside the edge guide 13, these portions enclosing a manifold space 39 of C-shape encompassing the edge guide side of the guide channel, this space being in communication at the top with the air passages 23*a* at the top, at the bottom with the air passages 23*b* at the bottom and at the side with the air passages 23*c* in the edge guide, outlet 29 being in communication with space 39.

The lower portion 33 of the manifold is constituted by an end portion of a bar 41 which serves as a bracket for mounting the guide channel in position relative to the sewing machine or the like on which the guide channel is used. This end portion of the bar is formed with a recess 43 providing the bottom portion of the space 39. The width of the bar is less than the length of the guide channel. The latter extends over the end of the bar 41 a distance less than the width of the recess 43 so that the edge guide 13 is spaced outwardly from the inner edge of the recess. The upper portion 35 of the manifold comprises a member having a part overlying the guide channel and a part extending down to the bar 41 on the outside of the edge guide 13 of the guide channel, these parts being cored out to provide a recess at 45 above air passages 23*a* and a recess at 47 alongside air passages 23*c*, with recess 47 extending down to recess 43. Member 35 has the air outlet 29 with a nipple 49 for connection of an air line 51 leading to the inlet of the vacuum pump.

Figure 2:
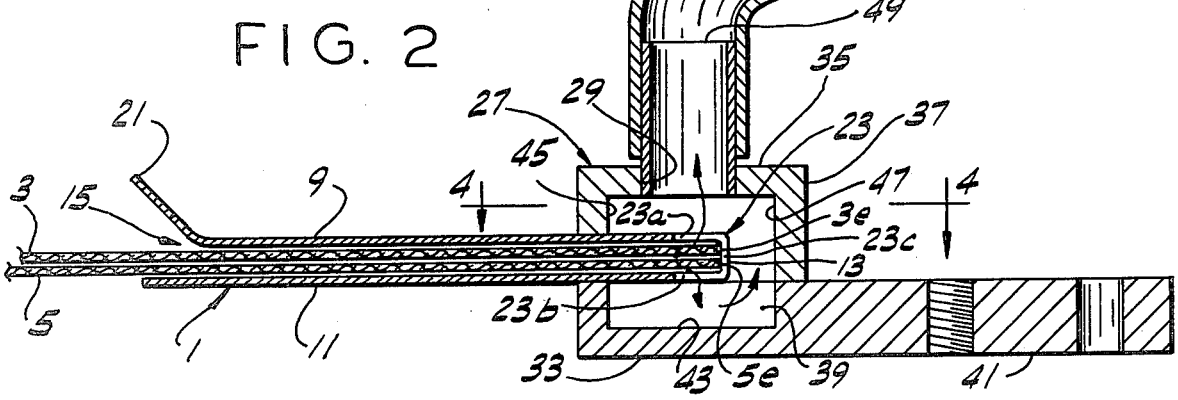
FIG. 2 is a vertical transverse section on line 2—2 of FIG. 1.

In the operation of the apparatus, air is continuously evacuated from the manifold 27 by the pump 31, thereby drawing air into the guide channel 1 from its open side at 15 (and from its open ends at 17 and 19) and causing the air to flow toward the edge guide side of the channel (its right side as viewed in FIGS. 1–4) and thence out through the air passages 23, as indicated by the directional arrows in FIG. 2. The work, e.g., the two superposed plies 3 and 5 shown in FIGS. 1 and 2, is entered in the channel and fed forward through the sewing machine for being stitched along the edges 3*e* and 5*e* of the work (i.e., for being stitched a predetermined distance, e.g., one-quarter inch) in from the edges. The space between the upper and lower members 9 and 11 of the guide is somewhat greater than the total thickness of the work so that air may flow in the channel above and below the work in the direction from the open side 15 of the channel toward the edge guide side of the channel. It is believed that air thus flows above and below the work and provides an antifriction air cushion between the top of the work and the upper member 9 of the guide and an antifriction air cushion between the bottom of the work and the lower member 11 of the channel for low-friction free passage of the work through the channel. The air also biases the work laterally in the direction toward the edge guide 13 (i.e., toward the right as viewed in FIGS. 1 and 2) for engagement with the edge guide 13 of the edges 3*e* and 5*e* of the work toward the edge guide 13, thereby aligning the edges one with the other. In the case of the two plies 3 and 5 of fabric, it is believed air enters between the two plies of the fabric (the fabric being porous) and provides an antifriction air cushion between the two plies so that the plies in effect "float" and are individually freely movable for edge alignment thereof against the edge guide. While the edges 3*e* and 5*e* of the work slide against the edge guide 13, the friction here is relatively low.

Figure 3:
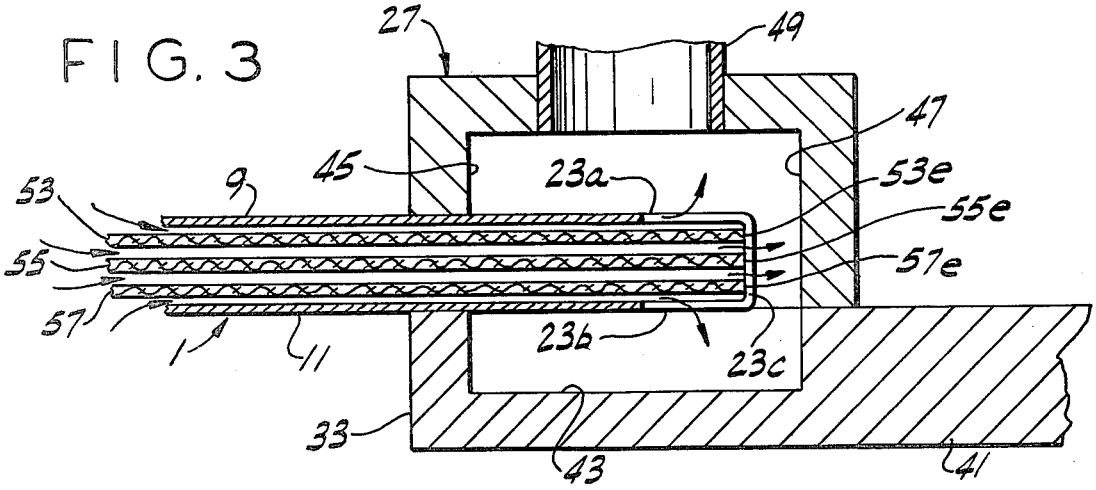
FIG. 3 is a fragmentary view similar to FIG. 2 on a larger scale than FIG. 2 showing three plies being fed to the needle.

The guide channel 1 is useful for guiding a single ply of material, in which case the edge of the ply is guided without alignment with another ply, and useful for guiding more than two plies with alignment of the edges of all the plies. Thus, FIG. 3 shows the guidance of three plies 53, 55 and 57. Here it is believed air flows between the top ply 53 and the intermediate ply 55 and between the intermediate ply 55 and the bottom ply 57 providing antifriction air cushions between the plies as well as between the upper member 9 of the channel 1 and the top ply and between the bottom ply and the lower member 11 of the channel so that all three plies "float" for the free lateral movement of all the plies for engagement of their edges 53*e*, 55*e* and 57*e* with the edge guide 13 for the alignment of said edges.

Guide means 1 with different spacing of the upper and lower members 9 and 11 are used for guiding different types of materials and work of different total thickness. The spacing is such as to provide for sufficient clearance in the guide means for flow of air in the direction toward the edge guide 13 in such amount and at such velocity as to move the plies of the work laterally toward the edge guide 13 for engagement with the edge guide of the edges of the plies toward the edge guide. It will be recognized that if the clearance is either too high or too low, the force of the air on the plies may not be sufficient to move them laterally. Also, if too low, there may be excessive friction on the plies. The spacing to use for different fabrics and different total work thicknesses is readily determined by using guide means with different spacing and selecting the guide means with the spacing which, for the particular vacuum pulled in the guide means, provides the force of air which effects the lateral movement of the plies toward the edge guide. In this regard, it will be understood that a guide means with the upper and lower members adjustable toward and away from one another may be used. Also, air channels extending laterally of the upper and lower members in their opposed faces may be used.

Figure 5:
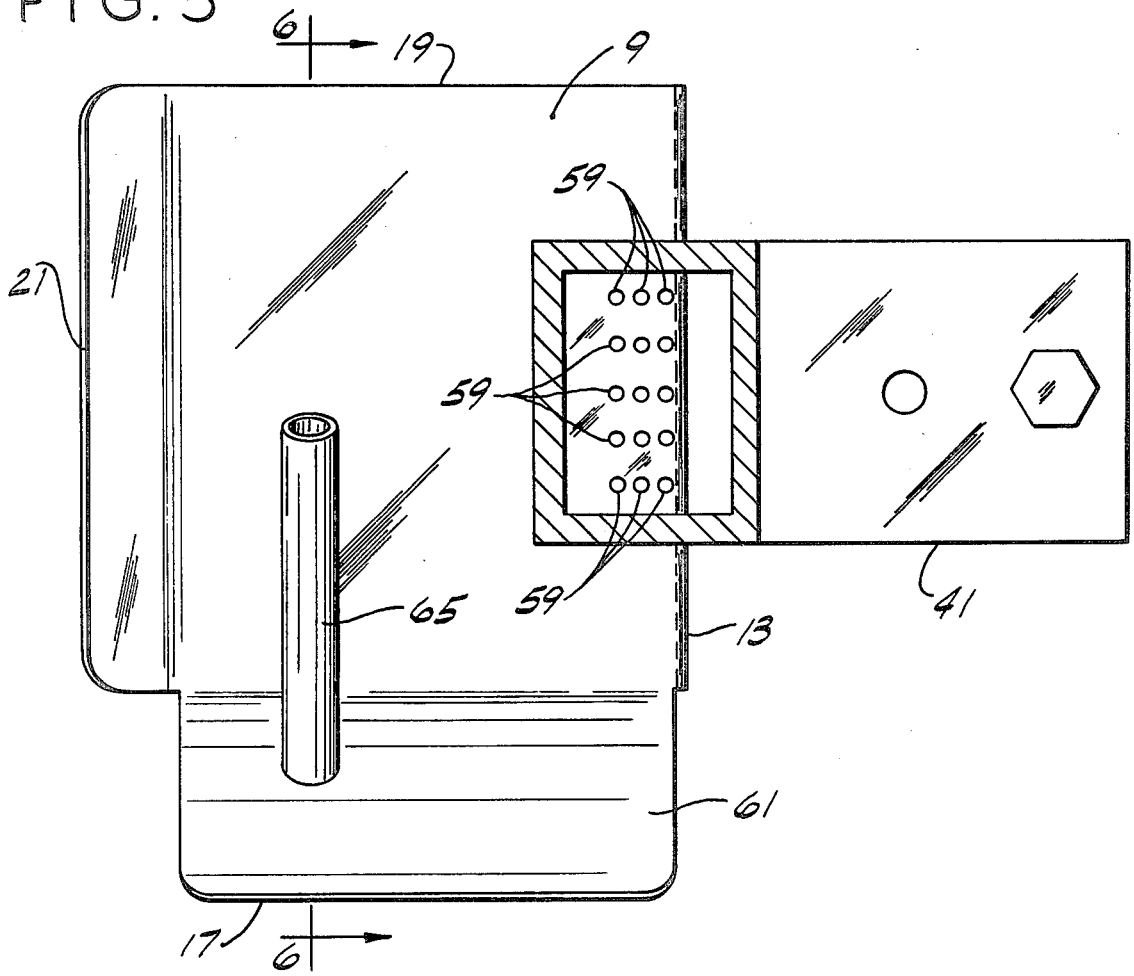
FIG. 5 is a view similar to FIG. 4 showing certain modifications.
Figure 6:
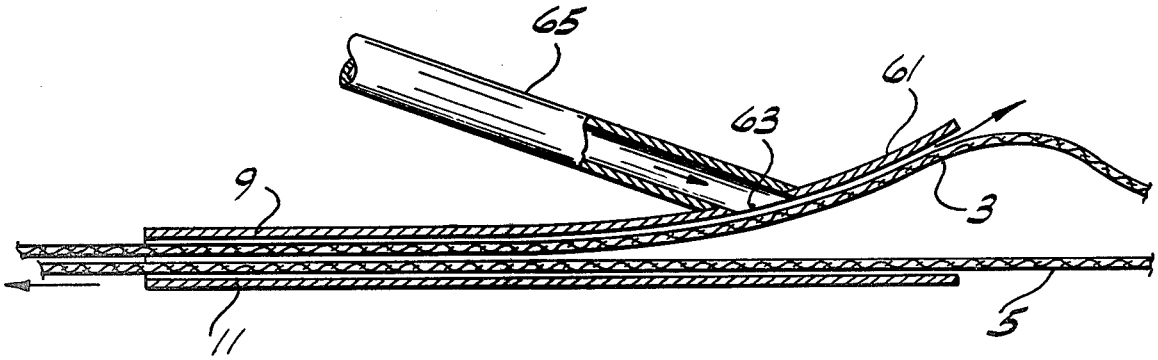
FIG. 6 is a longitudinal section on line 6—6 of FIG. 5.

FIG. 5 shows a modification wherein the air passages are formed by holes 59 in the upper and lower members 9 and 11 of the channel 1 located adjacent its edge guide side. This may be preferable to the slots 23 of FIG. 4 where undue fraying of ply edges may result from passage of the edges over the narrow areas of the edge guide 13 between slots. FIG. 5 also shows the addition of means for directing a flow of air into the guide channel 1 through one of the members 9 and 11 in a direction to effect separation of the plies of material as they travel through the guide channel. As shown in FIG. 5, and in FIG. 6, the upper member 9 of the guide channel is formed with a portion 61 at its entrance end (its upstream end) flaring away from the lower member 11. The means for directing a flow of air into the guide channel comprises at least one air passage 63 in said flaring portion 61 positioned for a flow of air along the inside of said flaring portion 61 in the direction toward the end of the guide channel that first engages the work when the work enters the guide means, air being blown in through this passage via a pipe 65. The air flows rearward along the inside of the flaring portion 61 (rearward in relation to the direction of travel of the work) via the so-called Coanda effect, and effects separation of the upper ply 3 from the lower ply 5 as shown in FIG. 6.

The apparatus of this invention is useful for guiding work in a wide variety of situations, and is particularly useful with apparatus for runstitching work, such as collars.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for guiding work through a sewing machine or the like comprising guide means through which the work is fed to the machine, said guide means having a first and second side, said guide means comprising an upper member and a lower member spaced apart for passage therebetween of the work and an edge guide at said first side of said upper and lower members for engagement by the edge of the work toward said first side as the work travels through said guide means, said guide means being open at said second side and at both ends for passage of the work therethrough and for entry of air to the space between said members, said guide means having at least one air passage at said first side thereof, and vacuum means connected to said air passage for drawing air into said guide means and causing it to flow toward said first side of the guide means and thence out through said air passage, the air flow biasing the work laterally in the direction toward said edge guide for engagement with the edge guide of the edge of the work toward the edge guide, said upper and lower members being spaced apart a distance greater than the total thickness of the work so that the air can flow in the guide means above and below the work in the direction from said second side of the guide means towards the edge guide.

2. Apparatus as set forth in claim 1 wherein said guide means comprises a channel constituted by said upper and lower members and having said edge guide at said first side thereof, said channel having a plurality of air passages spaced along its length at said first side thereof, and said vacuum means comprising a vacuum manifold in sealed relation with the channel and in communication with the air passages having an outlet for connection to means for drawing air out of the manifold and thus drawing air into the channel and causing it to flow toward said one side of the channel and thence out through said air passages.

3. Apparatus as set forth in claim 2 wherein said channel has said air passages in its said upper and lower members at its said first side.

4. Apparatus as set forth in claim 3 wherein the air passages are holes in the upper and lower members of the channel located adjacent said first side of the channel.

5. Apparatus as set forth in claim 3 wherein said guide channel also has said air passages in the said edge guide.

6. Apparatus as set forth in claim 5 wherein the air passages in the upper and lower members and in the edge guide are formed by slots in the channel extending in from said first side of the channel spaced at intervals along the length of the channel.

7. Apparatus as set forth in claim 1 having means for directing a flow of pressurized air into the guide means through one of said members, said pressurized air means being located in said one of said members near the end of said one of said members that first engages the work when the work enters the guide means and being spaced apart from the air passage, said flow of air being directed with a directional component opposite to the direction of travel of the work traveling through the guide means to effect separation of the plies of material at said end of the guide means as they travel through the guide means.

8. Apparatus for guiding work through a sewing machine or the like comprising guide means through which the work is fed to the machine, said guide means having a first and second side, said guide means comprising an upper member and a lower member spaced apart for passage therebetween of the work and an edge guide at said first side of said upper and lower members for engagement by the edge of the work toward said first side as the work travels through said guide means, said guide means being open at said second side and at both ends for passage of the work therethrough and for entry of air to the space between said members, said guide means having at least one air passage at said first side thereof, and vacuum means connected to said air passage for drawing air into said guide means and causing it to flow toward said first side of the guide means and thence out through said air passage, the air flow biasing the work laterally in the direction toward said edge guide for engagement with the edge guide of the edge of the work toward the edge guide, wherein said guide means comprises a channel constituted by said upper and lower members and having said edge guide at said first side thereof, said channel having a plurality of air passages spaced along its length at said first side thereof, said vacuum means comprising a vacuum manifold in sealed relation with the channel and in communication with the air passages having an outlet for connection to means for drawing air out of the manifold and thus drawing air into the channel and causing it to flow toward said first side of the channel and thence out through said air passages, wherein said channel has said air passages in its said upper and lower members at its said first side and wherein the manifold has a lower portion below the lower member, an upper portion above the upper member, and a portion extending alongside said edge guide, said portions enclosing a space in communication with said air passages, and said outlet being in communication with said space.

9. Apparatus as set forth in claim 8 wherein the manifold has a bracket for mounting the channel in position relative to the sewing machine or the like.

10. Apparatus for guiding work through a sewing machine or the like comprising guide means through which the work is fed to the machine, said guide means having a first and second side, said guide means comprising an upper member and a lower member spaced apart for passage therebetween of the work and an edge guide at said first side of said upper and lower members for engagement by the edge of the work toward said first side as the work travels through said guide means, said guide means being open at said second side and at both ends for passage of the work therethrough and for entry of air to the space between said members, said guide means having at least one air passage at said first side thereof, and vacuum means connected to said air passage for drawing air into said guide means and causing it to flow toward said first side of the guide means and thence out through said air passage, the air flow biasing the work laterally in the direction toward said edge guide for engagement with the edge guide of the edge of the work toward the edge guide, wherein said guide means comprises a channel constituted by said upper and lower members and having said edge guide at said first side thereof, said channel having a plurality of air passages spaced along its length at said first side thereof, and said vacuum means comprising a vacuum manifold in sealed relation with the channel and in communication with the air passages having an outlet for connection to means for drawing air out of the manifold and thus drawing air into the channel and causing it to flow toward said first side of the channel and thence out through said air passages, wherein said channel has said air passages in its said upper and lower members at its said first side and in its said edge guide and wherein the manifold has a lower portion below the lower member, an upper portion above the upper member and a portion extending alongside said edge guide, said portions enclosing a space in communication with the air passages in the upper member, with the air passages in the lower member, and with the air passages in the edge guide.

11. Apparatus as set forth in claim 10 wherein the manifold has a bracket for mounting the channel in position relative to the sewing machine or the like.

12. Apparatus as set forth in claim 10 wherein the air passages in the upper and lower members and in the edge guide are formed by slots in the channel extending in from said first side of the channel spaced at intervals along the length of the channel.

13. Apparatus as set forth in claim 12 wherein the manifold has a bracket for mounting the channel in position relative to the sewing machine or the like.

14. Apparatus for guiding work through a sewing machine or the like comprising guide means through which the work is fed to the machine, said guide means having a first and second side, said guide means comprising an upper member and a lower member spaced apart for passage therebetween of the work and an edge guide at said first side of said upper and lower members for engagement by the edge of the work toward said first side as the work travels through said guide means, said guide means being open at said second side and at both ends for passage of the work therethrough and for entry of air to the space between said members, said guide means having at least one air passage at said first side thereof, vacuum means connected to said air passage for drawing air into said guide means and causing it to flow toward said first side of the guide means and thence out through said air passage, the air flow biasing the work laterally in the direction toward said edge guide for engagement with the edge guide of the edge of the work toward the edge guide, means for directing a flow of air into the guide means through one of said members in a direction to effect separation of plies of material as they travel through the guide means and wherein one of said members has a portion at the end first engaging the work when the work enters the guide means flaring away from the other member, and said means for directing said flow of air comprises at least one outflow air passage in said one member positioned for a flow of air along the inside of said flaring portion in the direction toward said end of the guide means first engaging the work.

15. Apparatus as set forth in claim 14 wherein the upper member has said flaring portion.

* * * * *